US009063449B2

(12) United States Patent
Imai

(10) Patent No.: US 9,063,449 B2
(45) Date of Patent: Jun. 23, 2015

(54) ELECTROPHOTOGRAPHIC IMAGE FORMING APPARATUS

(75) Inventor: Yuichiro Imai, Kashiwa (JP)

(73) Assignee: CANON KABUSHIKI KAISHA (JP)

( * ) Notice: Subject to any disclaimer, the term of this patent is extended or adjusted under 35 U.S.C. 154(b) by 417 days.

(21) Appl. No.: 13/537,200

(22) Filed: Jun. 29, 2012

(65) Prior Publication Data

US 2013/0016987 A1 Jan. 17, 2013

(30) Foreign Application Priority Data

Jul. 12, 2011 (JP) ..... 2011-153873

(51) Int. Cl.

| | |
|---|---|
| ***G03G 15/043*** | (2006.01) |
| ***G03G 15/02*** | (2006.01) |
| ***G03G 15/01*** | (2006.01) |
| ***G03G 15/00*** | (2006.01) |

(52) U.S. Cl.

CPC ..... *G03G 15/011* (2013.01); *G03G 15/043* (2013.01); *G03G 15/0189* (2013.01); *G03G 15/5008* (2013.01); *G03G 2215/0158* (2013.01)

(58) Field of Classification Search

CPC ..... G03G 15/043; G03G 15/011; G03G 15/5008; G03G 15/0189; G03G 2215/0158

USPC ..... 399/51, 167

See application file for complete search history.

(56) References Cited

U.S. PATENT DOCUMENTS

| | | | | |
|---|---|---|---|---|
| 6,166,510 | A * | 12/2000 | Higashi et al. | 318/685 |
| 6,661,986 | B2 | 12/2003 | Kitayama | |

FOREIGN PATENT DOCUMENTS

| | | | |
|---|---|---|---|
| JP | 01112261 | A | 4/1989 |
| JP | 06-327278 | A | 11/1994 |
| JP | 08220966 | A | 8/1996 |
| JP | 09185192 | A | 7/1997 |
| JP | 2002235763 | A | 8/2002 |
| JP | 2003015501 | A | 1/2003 |
| JP | 2003186273 | A | 7/2003 |
| JP | 2004156730 | A | 6/2004 |
| JP | 2004264688 | A | 9/2004 |

OTHER PUBLICATIONS

Office Action issued in JP2011-153873, mailed Apr. 14, 2015.

* cited by examiner

*Primary Examiner* — Billy Lactaoen

(74) *Attorney, Agent, or Firm* — Rossi, Kimms & McDowell LLP

(57) ABSTRACT

An image forming apparatus capable of reducing fluctuations in the rotational speed of an image carrier caused by harmonic noise. A surface of the image carrier is charged with electricity. An exposure unit forms an electrostatic latent image by exposing on the charged surface of the image carrier to light. A rotational drive unit rotates the image carrier. A first detecting unit detects a rotational speed of the image carrier. A second detecting unit detects a home position of the image carrier. An exposure control unit controls timing with which the exposure unit exposes the image carrier to light based on the rotational speed of the image carrier detected by the first detecting unit and the home position detected by the second detecting unit.

12 Claims, 13 Drawing Sheets

COMPARATIVE EXAMPLE

PRESENT EXAMPLE

ELECTROPHOTOGRAPHIC IMAGE FORMING APPARATUS

BACKGROUND OF THE INVENTION

1. Field of the Invention

The present invention relates to an electrophotographic image forming apparatus such as a copier, a laser printer, or a facsimile which uses an electrophotographic process, and in particular to an arrangement of a drive unit used to drive a photosensitive member which the image forming apparatus has, and how the drive unit is controlled.

2. Description of the Related Art

Some image forming apparatuses form images using electrophotographic technology that electrostatically attracts and holds a developer comprised of fine powder. When images are to be formed using electrophotographic technology, first, an electrostatic latent image is formed on a surface of a photosensitive drum or a photosensitive belt which is an image carrier, and the formed electrostatic latent image is developed using toner which is a developer to generate a visible toner image. Then, the toner image is transferred onto a transfer material by a transfer device, and the toner image on the transfer material is fixed on the transfer material using pressure, heat, or the like. A print is thus obtained.

Obtaining an image comprised of a plurality of colors (color image) using electrophotographic technology can be realized by using developers of a plurality of colors. In principle, developers of respective colors, yellow, magenta, and cyan are used, and a color image is formed through color mixing that superposes toner images of the respective colors on top of one another. It should be noted that when a color image is to be formed, a black developer as well as colored developers is used as the need arises.

Examples of image forming apparatuses that form color images in the above described manner include an image forming apparatus in which developing devices for respective colors in which developers are stored are placed side by side on a straight line or a curve, and which forms and develops electrostatic latent images corresponding to the developers of the respective colors. Methods to form a color image by superposing toner images of respective colors on top of one another on a transfer material such as paper or a plastic sheet include a direct transfer method and an intermediate transfer method.

To form a high-quality color image on a transfer material, the rotation accuracy of an image carrier on which toner images are to be formed is required to be improved when any of the image forming apparatuses and the transfer methods described above is used. Accordingly, for example, there has been proposed a drive unit that detects a reference position of an image carrier using a sensor, and detects the rotational speed of the image carrier using a rotational speed detection unit such as an encoder (see, for example, Japanese Laid-Open Patent Publication (Kokai) No. H06-327278). This drive unit carries out feedforward control of rotational speed when rotation of the image carrier is started, and at this time, detects a reference position of the image carrier and obtains a rotational speed profile of the image carrier to generate a signal that cancels out fluctuations in rotational speed and output the same to a motor that drives the image carrier.

However, when fluctuations in the rotational speed of the image carrier include a fluctuation caused by harmonic noise (harmonic rotational speed fluctuation), response is too late if a harmonic noise countermeasure instruction (signal) is output to the motor that drives the image carrier, and as a result, fluctuations in the rotational speed of the image carrier cannot be canceled out. Accordingly, there is an approach that outputs a harmonic noise countermeasure instruction to an exposure unit having superior control responsiveness.

However, even when the control method that outputs a countermeasure instruction to cope with a harmonic rotational speed fluctuation to the exposure unit is used, a harmonic rotational speed fluctuation cannot be satisfactorily canceled out when there is a large temporal difference between a harmonic rotational speed fluctuation and a countermeasure instruction (signal). This is because in response to a low-frequency noise countermeasure instruction, real-time feedback control is carried out to cope with a fluctuation in the rotational speed of the motor that rotatively drives the image carrier. Namely, the rotational speed of the image carrier for which a countermeasure against low-frequency noise has been taken greatly varies from rotation to rotation, and the variation results in a large temporal difference between a harmonic rotational speed fluctuation and a countermeasure instruction (signal).

SUMMARY OF THE INVENTION

The present invention provides an image forming apparatus capable of reducing fluctuations in the rotational speed of an image carrier caused by harmonic noise.

Accordingly, a first aspect of the present invention provides an image forming apparatus comprising an image carrier whose surface is charged with electricity, an exposure unit configured to form an electrostatic latent image by exposing the charged surface of said image carrier to light, a rotational drive unit configured to rotate said image carrier, a first detecting unit configured to detect a rotational speed of said image carrier, a second detecting unit configured to detect a home position of said image carrier, and an exposure control unit configured to control timing with which said exposure unit exposes said image carrier to light based on the rotational speed of said image carrier detected by said first detecting unit and the home position detected by said second detecting unit, wherein said second detecting unit detects the home position in a phase that is a predetermined amount before a phase in which a harmonic rotational speed fluctuation of said image career occurs so that said exposure control unit can corrects for the harmonic rotational speed fluctuation.

According to the present invention, because in response to fluctuations in the rotational speed of the image carrier caused by harmonic noise, fluctuations in the rotational speed of the image carrier are suppressed, and the exposure device is controlled, high-quality images can be formed.

Further features of the present invention will become apparent from the following description of exemplary embodiments (with reference to the attached drawings).

BRIEF DESCRIPTION OF THE DRAWINGS

FIGS. 8A and 8B are perspective views showing intervals between scanning lines on the photosensitive drum shown in FIG. 1, in which FIG. 8A shows a comparative example in which a measure against harmonic rotational speed fluctuations by an exposure unit is not taken, and FIG. 8B shows an example in which the measure is taken.

DESCRIPTION OF THE EMBODIMENTS

The present invention will now be described in detail with reference to the drawings showing an embodiment thereof. An image forming apparatus according to the present invention forms an image on a recording medium using an electrophotographic image forming process, and specific examples of the image forming apparatus include an electrophotographic copier, an electrophotographic printer (such as a laser beam printer or an LED printer), a facsimile apparatus, and a word processor.

Figure 1:
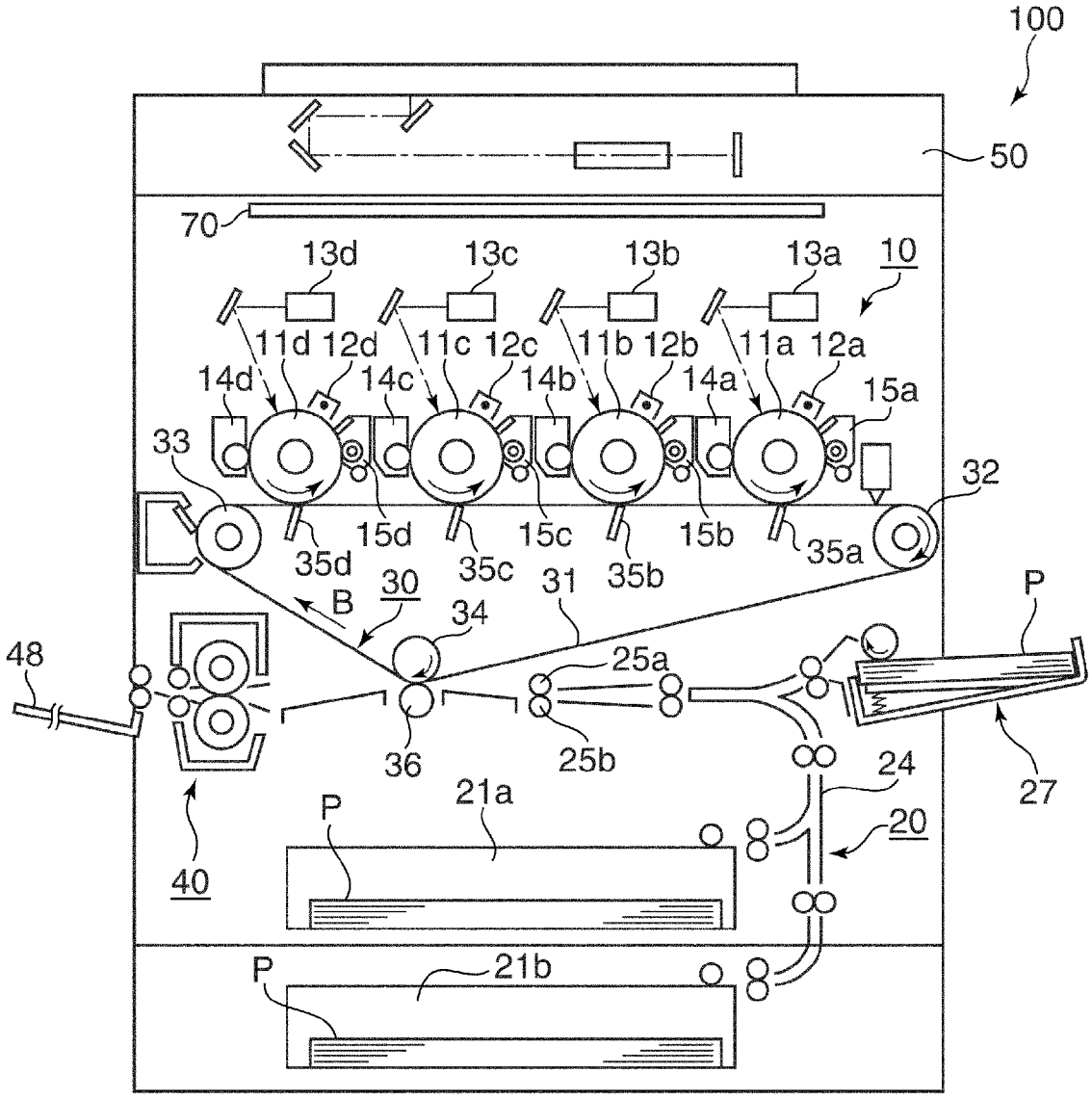
FIG. 1 is a cross-sectional view schematically showing an arrangement of an image forming apparatus according to an embodiment of the present invention.

FIG. 1 is a cross-sectional view schematically showing an arrangement of the image forming apparatus according to the present embodiment. The image forming apparatus 100 has mainly an image reading unit 50, a toner image forming unit 10, an intermediate transfer unit 30, a sheet feeding unit 20, and a fixing unit 40.

The image reading unit 50, for example, reads an original mounted on an original platen glass as an optical image although detailed description thereof is omitted.

The toner image forming unit 10 is comprised of a plurality of image forming units that form toner images of a plurality of colors, e.g. toner images of respective colors, yellow, magenta, cyan, and black. The image forming units have respective photosensitive drums 11*a* to 11*d*, which are image carriers disposed so as to be rotatable, and primary chargers 12*a* to 12*d* and exposure devices 13*a* to 13*d* for forming electrostatic latent images on the photosensitive drums 11*a* to 11*d* are disposed around the respective photosensitive drums 11*a* to 11*d*.

Also, developing devices 14*a* to 14*d* for forming toner images and photosensitive member cleaners 15*a* to 15*d* that remove excess toner on the photosensitive drums 11*a* to 11*d* after toner images are transferred onto an intermediate transfer belt 31 are disposed around the respective photosensitive drums 11*a* to 11*d*.

The intermediate transfer unit 30 is disposed under the toner image forming unit 10. The intermediate transfer unit 30 has the intermediate transfer belt 31 looped over a driving roller 32 and driven rollers 33 and 34. The intermediate transfer unit 30 also has primary transfer blades 35*a* to 35*d*, which come into contact with the photosensitive drums 11*a* to 11*d* via the intermediate transfer belt 31 and primarily transfer toner images on the photosensitive drums 11*a* to 11*d* onto the intermediate transfer belt 31. A secondary transfer roller 36, which secondarily transfers toner images on the intermediate transfer belt 31 onto a transfer sheet, is disposed in opposed relation to the roller 34.

The sheet feeding unit 20 has storage cassettes 21*a* and 21*b* in which transfer sheets P are stored. It should be noted that the image forming apparatus 100 has a manual feed tray 27 for feeding transfer sheets P from outside. The transfer sheets P are taken out one by one from any of the storage cassettes 21*a* and 21*b* and the manual feed tray 27 by sheet feeding rollers and conveyed along a conveying path 24.

Then, skew of the transfer sheet P is corrected for by registration rollers 25*a* and 25*b*, and the transfer sheet P is conveyed to a nip between the intermediate transfer belt 31 and the secondary transfer roller 36 with predetermined timing. When the transfer sheet P leaves the nip between the intermediate transfer belt 31 and the secondary transfer roller 36, toner images on the intermediate transfer belt 31 are transferred onto the transfer sheet P.

The transfer sheet P onto which the toner images have been transferred is conveyed to the fixing unit 40. The fixing unit 40 carries out a fixing process to fix the toner images on the transfer sheet P using heat and pressure. The transfer sheet P for which the fixing process has been thus completed is discharged onto a discharged sheet tray 48.

In the image forming apparatus arranged as described above, an image signal from a reader unit (not shown) is temporarily stored on image memory in the exposure devices 13*a* to 13*d* and then converted into an optical signal (laser light) by a laser output unit. The laser light is irradiated (scanned) on surfaces of the photosensitive drums 11*a* to 11*d*.

Prior to the irradiation of the laser light onto the surfaces of the photosensitive drums 11*a* to 11*d*, the photosensitive drums 11*a* to 11*d* are uniformly charged with electricity by the primary chargers 12*a* to 12*d*. As a result, electrostatic latent images are formed on the photosensitive drums 11*a* to 11*d* through the irradiation of the laser light onto the photosensitive drums 11*a* to 11*d*. The electrostatic latent images thus formed are developed by the developing devices 14*a* to 14*d* using developers (toner) to form toner images.

The toner images of the respective colors formed on the photosensitive drums 11*a* to 11*d* are primarily transferred onto the intermediate transfer belt 31 in order from the left-hand side photosensitive drum 11*d* such that the toner images are superposed on top of each other without color misregistration. The toner images of the four colors thus superposed on the intermediate transfer belt 31 are transferred onto the transfer sheet P by the secondary transfer roller 36.

In the case of a tandem-type image forming apparatus such as the image forming apparatus 100 in which the four photosensitive drums 11*a* to 11*d* are placed in tandem with one another, and toner images of the four colors are superposed on top of one another on the intermediate transfer belt 31, toner images of the four colors are misaligned when they are superposed in a case where image superposing accuracy is considered on the order of μm. This misalignment is called "color misregistration". Examples of factors that cause color misregistration include a change in the rotation speed of the photosensitive drums 11*a* to 11*d* (drum rotational speed), a change in ITB speed, the performance of the exposure devices 13*a* to 13*d*, and an increase in the temperature in the image forming apparatus 100 during operation.

One of techniques to reduce or eliminate color misregistration is so-called "automatic registration" that, when images of the respective colors are transferred onto the intermediate transfer belt 31, measures deviations of transfer positions using a sensor and corrects the transfer positions. However, color misregistration caused by a change in drum rotational speed cannot be corrected for by the automatic registration. Accordingly, in order to reduce color misregistration, it is necessary to prevent a change in drum rotational speed. Accordingly, a detailed description will now be given of an arrangement that prevents the occurrence of color misregistration in the image forming apparatus 100.

Figure 2:
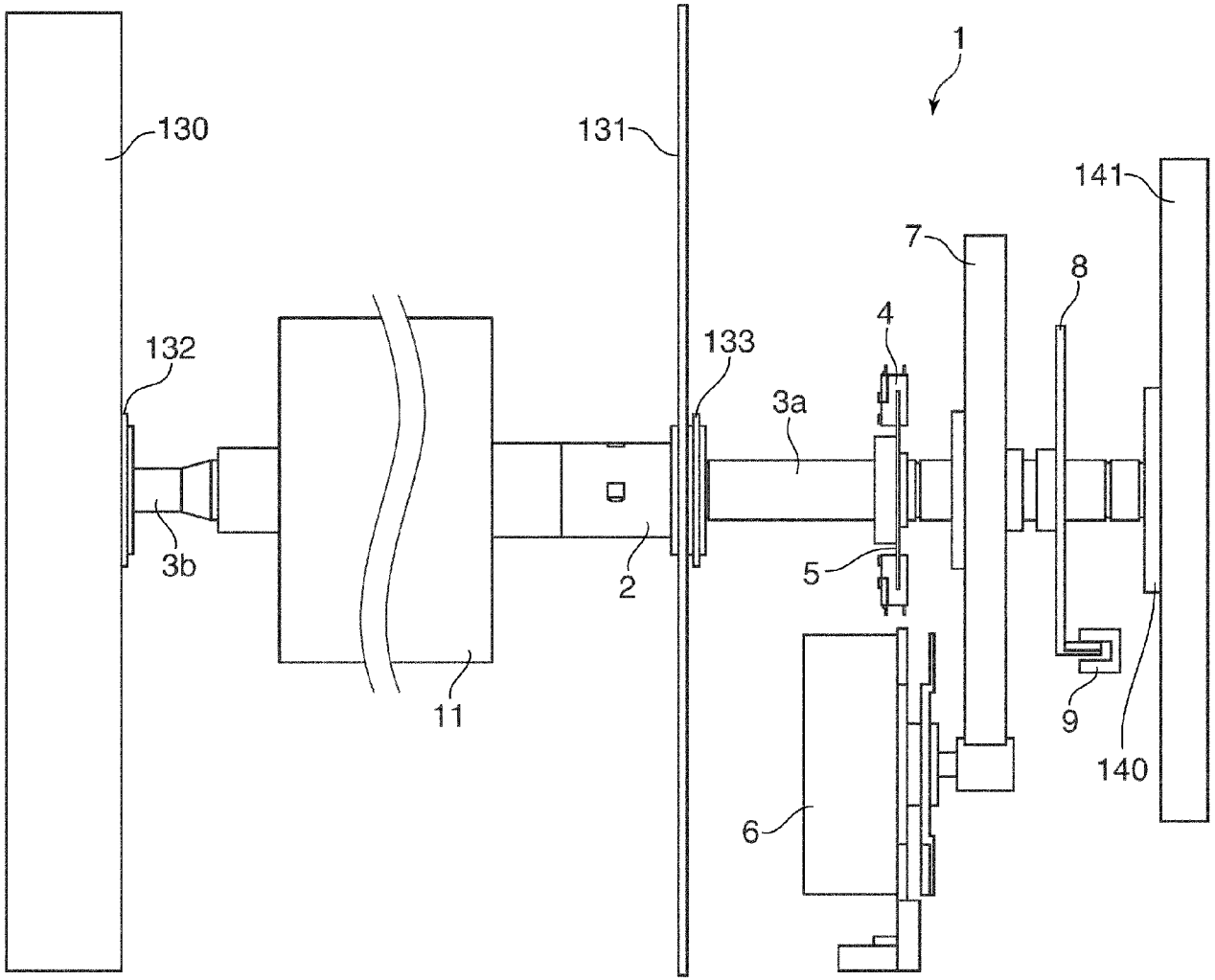
FIG. 2 is a side view schematically showing an arrangement of a drum drive unit in the image forming apparatus shown in FIG. 1 and showing how the drum drive unit is supported.

FIG. 2 is a side view schematically showing an arrangement of a drum drive unit in the image forming apparatus 100 and showing how the drum drive unit is supported. The photosensitive drums 11*a* to 11*d* have the same arrangement, and the drum drive unit 1 is applied to each of the photosensitive drums 11*a* to 11*d* in the same manner. Thus, in the following description, "the photosensitive drums 11*a* to 11*d*" will be referred to as "the photosensitive drum 11".

One end of a rotary shaft 3*b* (first rotary shaft), which is fixed to the photosensitive drum 11 in such a manner as to penetrate the center of the photosensitive drum 11, is fitted on a bearing 132 disposed on a front inner door 130, and a joint (not shown) is provided at the other end of the rotary shaft 3*b*.

The drum drive unit 1 has a drive motor 6 that produces rotative force, and a drum gear 7 that engages with a gear, not shown, provided on a shaft of the drive motor 6. A rotary shaft 3*a* (second rotary shaft) of the drum drive unit 1 and the drum gear 7 are fitted on each other in a rotation-inhibited state. A bearing 133 is disposed so as to be fitted in a hole provided in a rear side plate 131, and the rotary shaft 3*a* is rotatably fitted on the bearing 133. A coupling 2, which is to be engaged with the joint provided at one end of the rotary shaft 3*b* penetrating the photosensitive drum 11, is provided at an end of the rotary shaft 3*a* on the photosensitive drum 11 side.

Thus, when the drive motor 6 is run, rotative drive force from the shaft of the drive motor 6 is transmitted to the rotary shaft 3*a* via the drum gear 7, causing the rotary shaft 3*a* to rotate. Then, rotative drive force from the rotary shaft 3*a* is transmitted to the rotary shaft 3*b* via the coupling 2 and the joint, thus rotatively driving the photosensitive drum 11.

An encoder wheel 5 is mounted on the rotary shaft 3*a* by a rotation-inhibiting arrangement (not shown), and a pair of encoder sensors 4 are disposed in such a manner as to sandwich the encoder wheel 5 and face each other at a phase interval of 180 degrees.

A home position flag 8 (hereafter referred to as "the HP flag 8"), which is a unit that detects a reference position of the photosensitive drum 11, is mounted on the rotary shaft 3*a*. The HP flag 8 is detected by a home position sensor 9 (hereafter referred to as "the HP sensor 9") provided in the drum drive unit 1.

Figure 3:
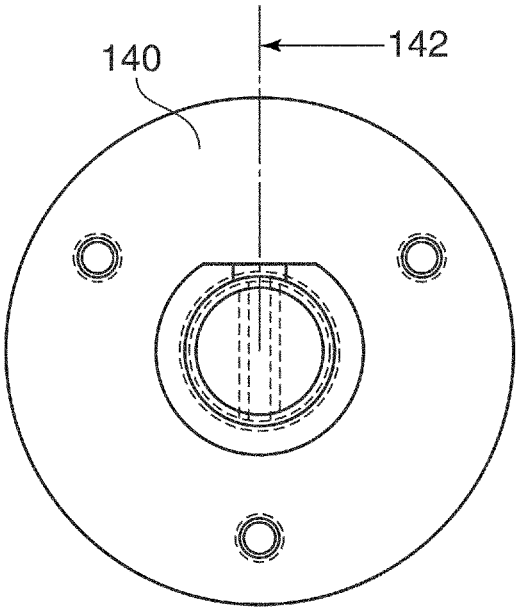
FIG. 3 is a front view showing how an inertial member is mounted on a rotary shaft of the drum drive unit shown in FIG. 2.

An inertial member (flywheel) 141 is mounted on the rotary shaft 3*a* via a fixed part 140. The inertial member 141 attenuates a disturbance applied to the rotary shaft 3*a*, thus enabling the rotary shaft 3*a* to rotate at a stable speed. FIG. 3 is a front view showing how the inertial member 141 is mounted on the rotary shaft 3*a*. The fixed part 140 is fixed to the rotary shaft 3*a* by a screw penetrating the rotary shaft 3*a*. It should be noted that a phase in which the screw penetrates the rotary shaft 3*a* is expressed as a phase 142 in FIG. 3.

Figure 4A:
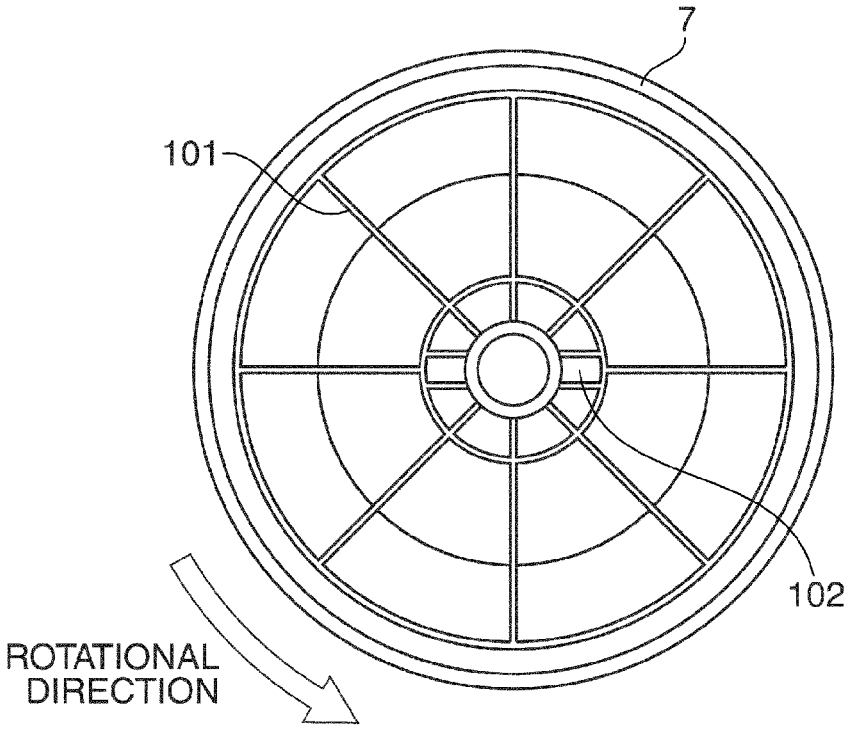
FIGS. 4A and 4B are a front view and a perspective view, respectively, schematically showing an arrangement of a drum gear shown in FIG. 2.
Figure 4B:
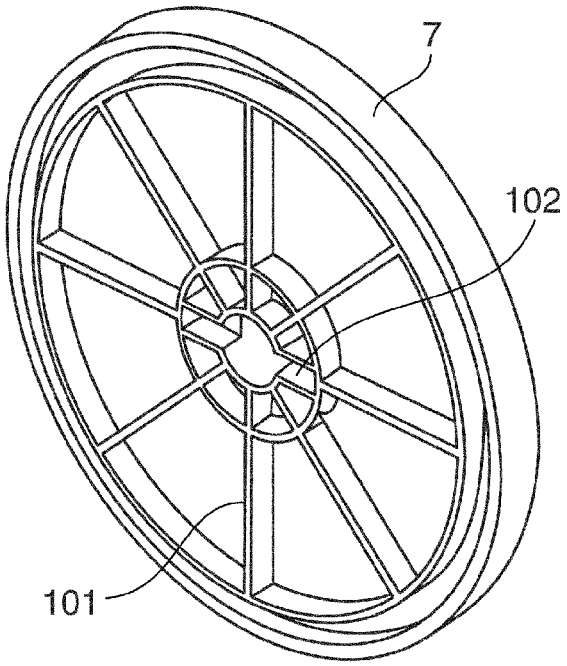

FIGS. 4A and 4B are a front view (FIG. 4A) and a perspective view (FIG. 4B), respectively, schematically showing an arrangement of the drum gear 7. The drum gear 7 has a rotation-inhibiting shape portion 102 formed in the vicinity of the center of the drum gear 7, and ribs 101 formed in a radial pattern. Parts that can be molded using dies and produced in volume can be used for the drum gear 7. In this case, there are gate positions in the drum gear 7, and in general, the all-teeth engagement accuracy of the drum gear 7 periodically changes in relation to the gate positions.

Figure 14A:
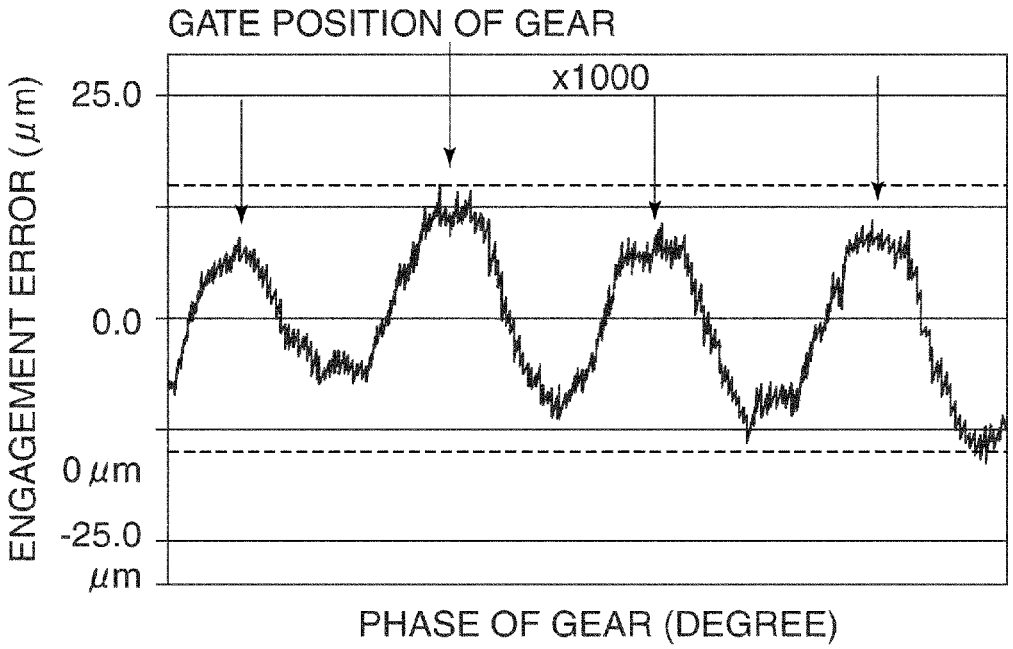
FIG.14A PRIOR ART
FIGS. 14A and 14B are graphs showing periodical changes in the all-teeth engagement accuracy of an ordinary drum gear.
Figure 14B:
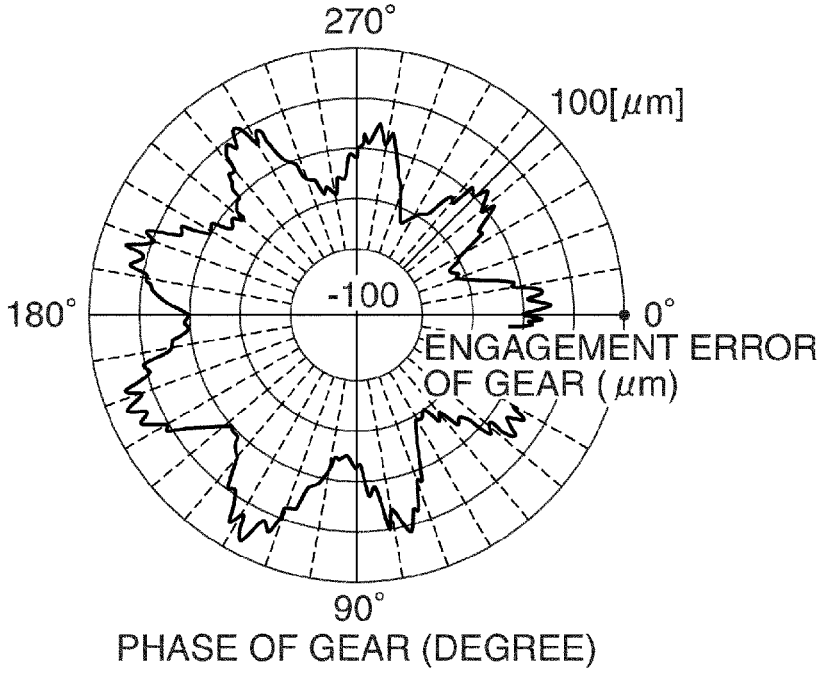

A brief description will now be given of periodical changes in the all-teeth engagement accuracy of the drum gear 7. FIGS. 14A and 14B are graphs showing periodical changes in the all-teeth engagement accuracy of ordinary drum gears. Referring to FIG. 14A, there are four crests (peaks), and these crests result from four gates provided in a drum gear. FIG. 14B shows the engagement error in a drum gear provided with eight ribs in a radial pattern, and the engagement error periodically changes in a manner corresponding to the number of ribs.

Figure 5:
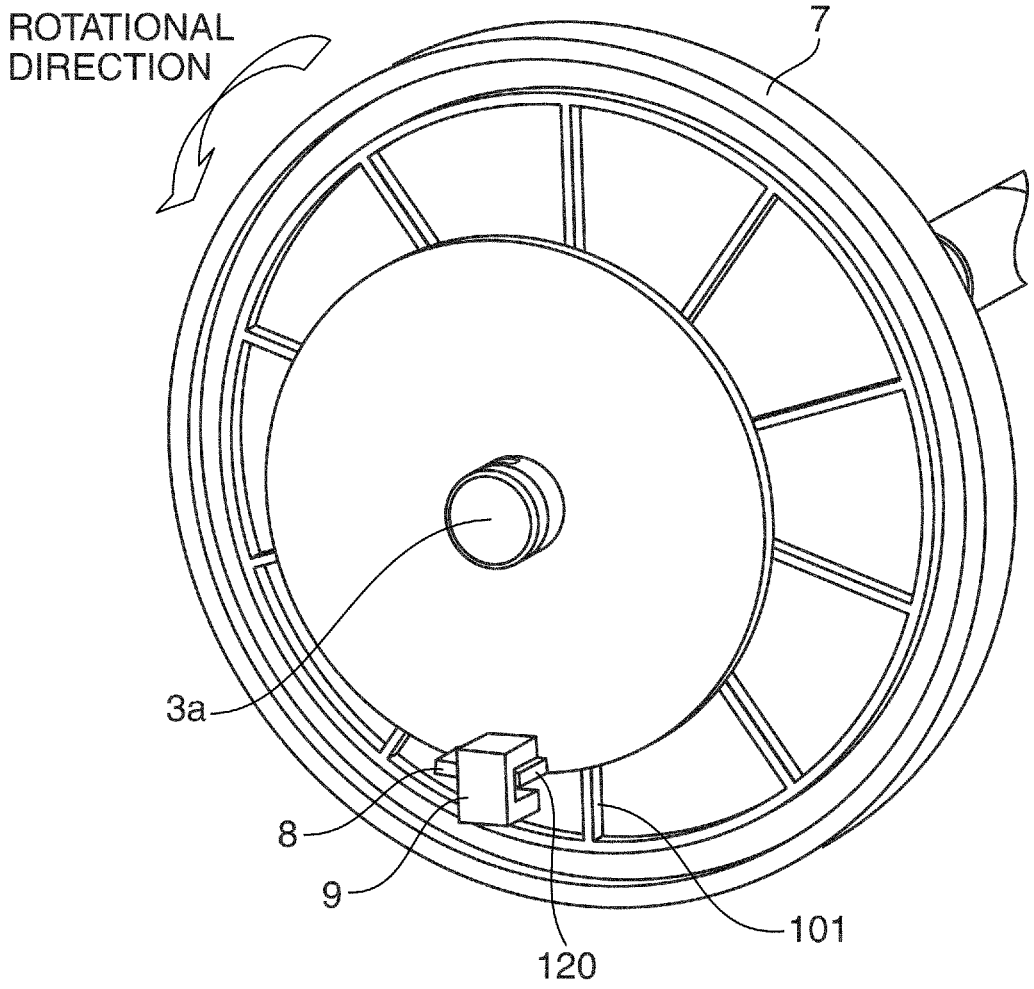
FIG. 5 is a perspective view showing locations at which an HP flag and an HP sensor are disposed with respect to the drum gear shown in FIGS. 4A and 4B.

FIG. 5 is a perspective view showing locations at which the HP flag 8 and the HP sensor 9 are disposed with respect to the drum gear 7. The HP sensor 9 is fixed, and the drum gear 7 and the HP flag 8 rotate at the same speed in accordance with rotation of the rotary shaft 3*a*. Thus, when the rotary shaft 3*a* rotates one revolution, the HP flag 8 also rotates one revolution, and hence whenever the rotary shaft 3*a* has rotated one revolution, the HP sensor 9 generates one pulse (HP signal) indicating that the HP flag 8 has been detected. The timing (phase) with which a leading portion 120 of the HP flag 8 crosses the HP sensor 9 first when the HP flag 8 is rotating determines the timing with which a control signal is input to the drive motor 6.

Figure 6A:
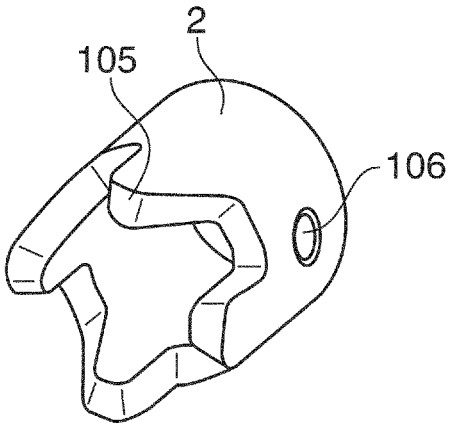
FIGS. 6A and 6B are a perspective view and a front view, respectively, schematically showing a shape of a coupling shown in FIG. 2.
Figure 6B:
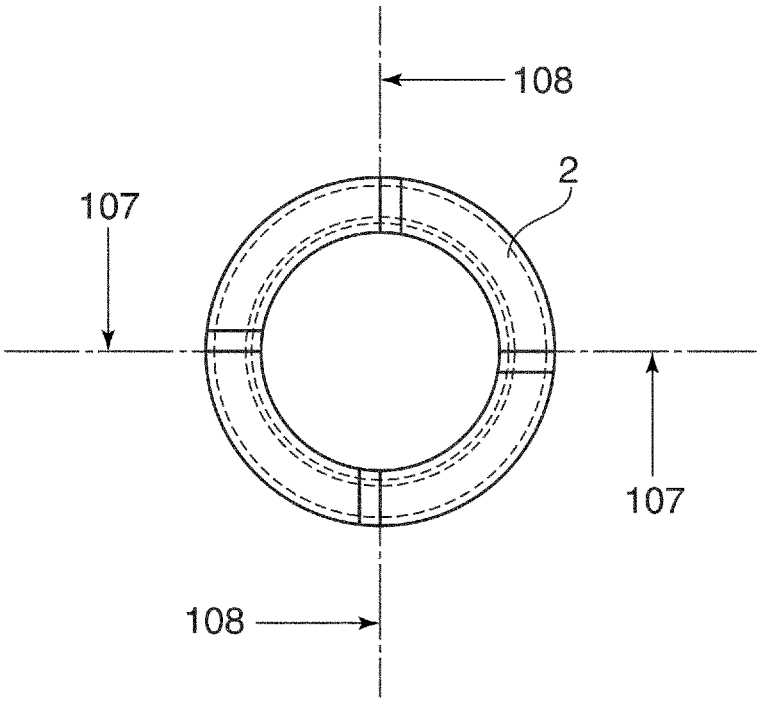

FIGS. 6A and 6B are a perspective view (FIG. 6A) and a front view (FIG. 6B), respectively, showing a shape of the coupling 2 provided on the rotary shaft 3*a*. As shown in the perspective view of FIG. 6A, the coupling 2 has four projecting portions 105, and the joint of the rotary shaft 3*b* on the photosensitive drum 11 side and the projecting portions 105 are engaged with each other, so that rotative force is transmitted from the coupling 2 to the joint. In the front view of FIG. 6B, a phase 107 represents a phase in which the projecting portions 105 and a coupling rotation-inhibiting portion 106 are overlapped as phases, and a phase 108 represents a phase of only the projecting portions 105.

Figure 7:
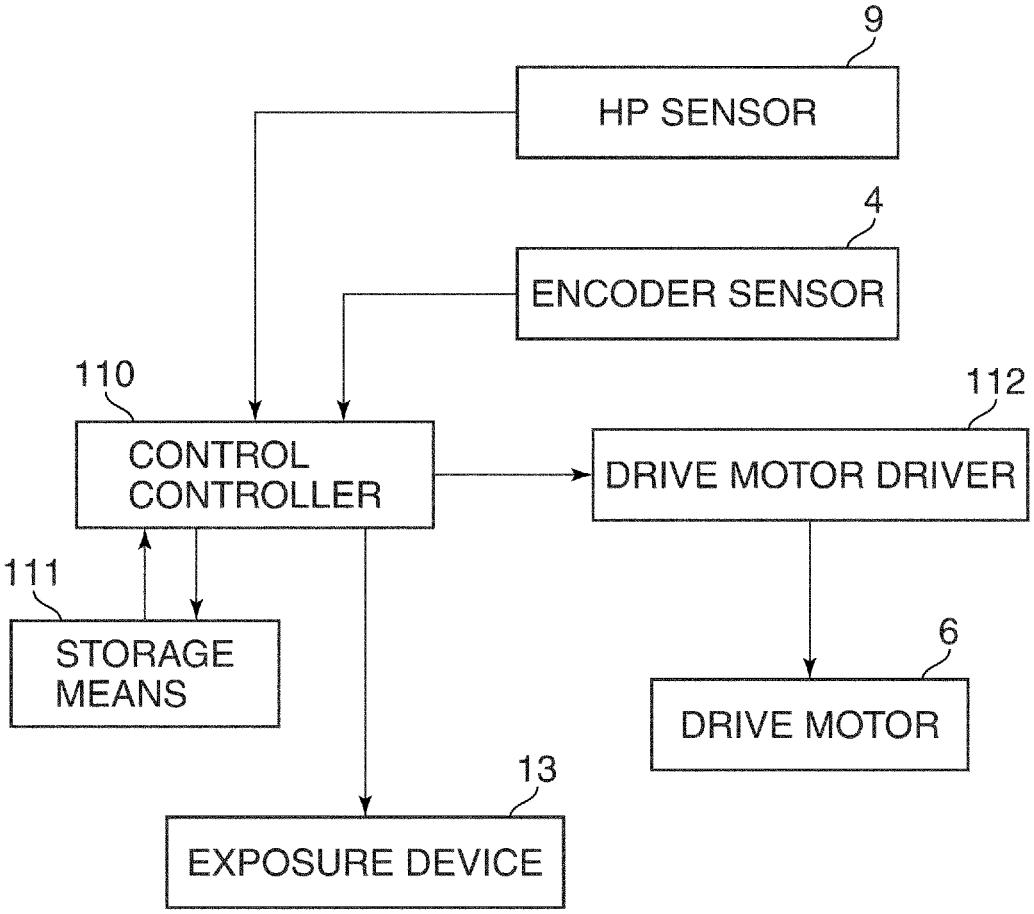
FIG. 7 is a block diagram schematically showing an arrangement of a drive system that drives the drum drive unit shown in FIG. 2.

FIG. 7 is a block diagram schematically showing an arrangement of a drive system that drives the drum drive unit 1. In order to produce toner images of the four colors, the drive system has the HP sensor 9, the encoder sensors 4, the drive motor 6, a control controller 110, and a drive motor driver 112 for each of the colors. It should be noted that the arrangement shown in FIG. 7 is for only one color, and arrangements for all the colors are not shown. Also, an "exposure device 13" shown in FIG. 7 corresponds to the exposure devices 13*a* to 13*d* described earlier.

The encoder sensors 4 detect the drum rotational speed of the photosensitive drum 11. The control controller 110 collectively controls rotative motions of the photosensitive drum 11 and exposure of the exposure device 13. To control the operation of the photosensitive drum 11, information on drum rotational speed obtained by the HP sensor 9 and the encoder sensors 4 is sent to the control controller 110. The control controller 110 sends a storage unit 111*a* profile on drum rotational speed based on positions of the HP flag 8 detected by the HP sensor 9, and the storage unit 111 stores this profile.

Based on the drum rotational speed profile stored in the storage unit 111, the control controller 110 outputs a control signal that cancels out fluctuations in drum rotational speed to the drive motor driver 112. The drive motor driver 112 drives the drive motor 6 in accordance with the control signal from the control controller 110. Also, based on drum rotational speed detection signals from the encoder sensors 4, the control controller 110 provides real-time feedback control that cancels out fluctuations in drum rotational speed mainly in a low-frequency region.

However, the real-time feedback control described above cannot cope with fluctuations in the drum rotational speed of the photosensitive drum 11 caused by harmonic noise (hereafter referred to as "harmonic rotational speed fluctuations"). Examples of methods to cope with such harmonic rotational speed fluctuations include a method that outputs a control signal to the exposure device 13.

Figure 13:
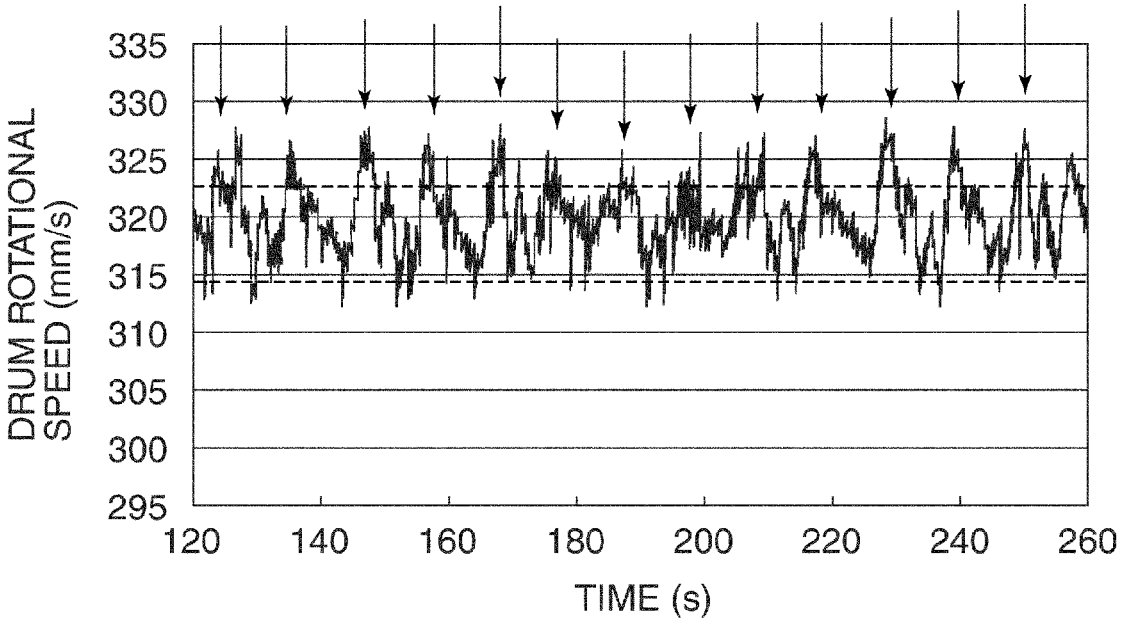
FIG.13 PRIOR ART
FIG. 13 is a graph showing ordinary temporal changes in the rotational speed of a photosensitive drum.

A description will now be given of harmonic rotational speed fluctuations. FIG. 13 is a graph showing ordinary temporal changes in the rotational speed of a photosensitive drum. When a harmonic rotational speed fluctuation occurs, drum rotational speed abruptly changes. Referring to FIG. 13, harmonic rotational speed fluctuations occur at times indicated by down-pointing arrows. When the real-time feedback control described above is used, the control controller 110 outputs a control signal that cancels out a speed change after detecting the speed change. For this reason, even if a control signal that cancels out an abrupt change is output, response by the drive motor 6 is too late, and as a result, fluctuations in drum rotational speed cannot be canceled out.

In the present embodiment, areas where harmonic rotational speed fluctuations occur include the phases in which there are the gates, the phases in which there are the ribs 101, and the phase in which there is the rotation-inhibiting arrangement (the position of the rotation inhibiting shaped portion 102) in the drum gear 7. Areas where harmonic rotational speed fluctuations occur also include the phase in which there is the coupling rotation-inhibiting portion 106 for the rotary shaft 3*a* (the phase 107), and the phase in which there are the projecting portions 105 (the phase 108) in the coupling 2 provided on the rotary shaft 3*a*. Further, areas where harmonic rotational speed fluctuations occur include the phase in which the fixed part 140 is fixed to the rotary shaft 3*a* so as to mount the inertial member 141 on the rotary shaft 3*a* (the phase 142). In addition, because the encoder wheel 5 is mounted on the rotary shaft 3*a* by the rotation-inhibiting arrangement, the phase in which there is the rotation-inhibiting arrangement for the rotary shaft 3*a* in the encoder wheel 5 is included in areas where harmonic rotational speed fluctuations occur.

In the present embodiment, a control signal that cancels out harmonic rotational speed fluctuations is output to the exposure device 13. A device such as a VCSEL or a line emitting device which has responsiveness superior to conventional edge emitting devices is used as the exposure device 13. Thus, color misregistration of toner images of the four colors caused by harmonic rotational speed fluctuations can be eliminated in μm.

Figure 8A:
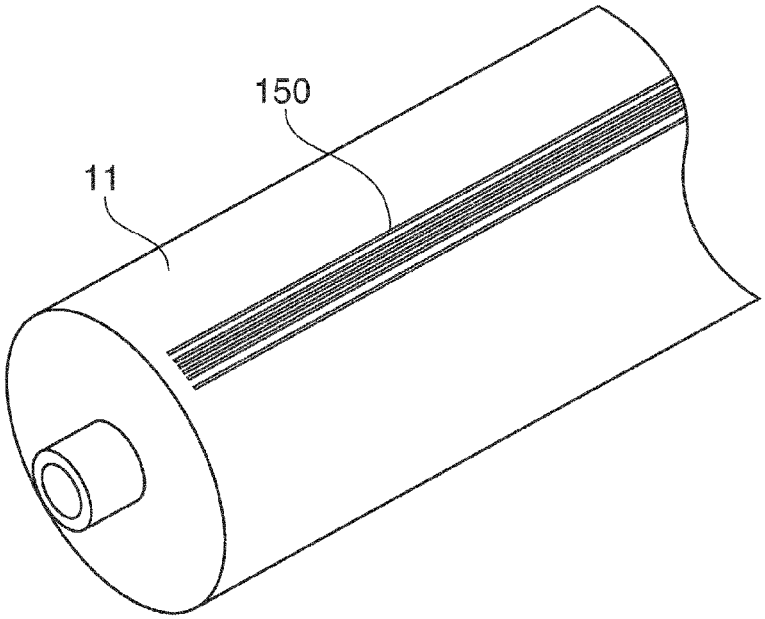
FIG.8A PRIOR ART
Figure 8B:
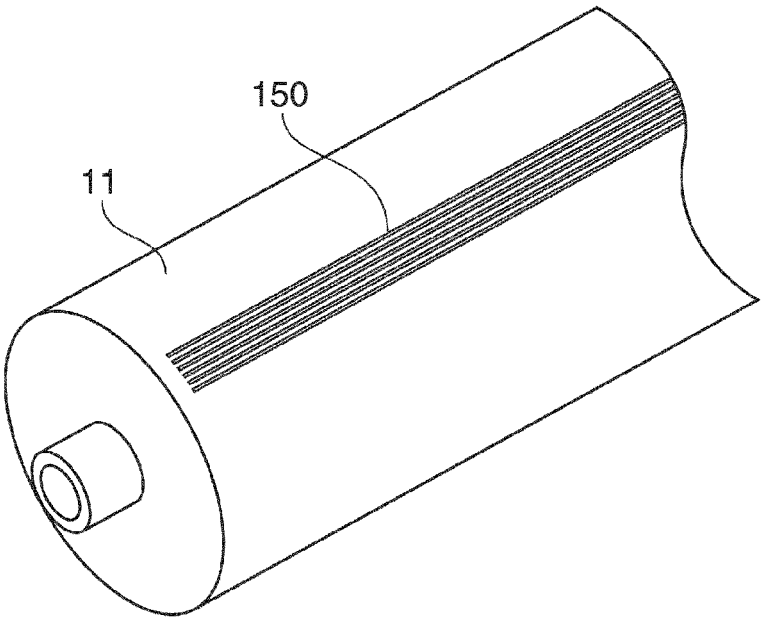

FIGS. 8A and 8B are perspective views showing intervals between scanning lines on the photosensitive drum 11, in which FIG. 8A shows a comparative example in which a measure against harmonic rotational speed fluctuations by the exposure unit 13 is not taken, and FIG. 8B shows an example in which the measure against harmonic rotational speed fluctuations by the exposure unit 13 is taken. As shown in FIG. 8A, when harmonic rotational speed fluctuations occur in the photosensitive drum 11, the intervals between scanning lines on the photosensitive drum 11 formed by the exposure device 13 are not uniform. Namely, when the intervals between times at which light is output from the exposure device 13 are uniform for scanning on the photosensitive drum 11, the interval between scanning lines is wide in an area where drum rotational speed is high, and the interval between scanning lines is narrow in an area where drum rotational speed is low.

Figure 9:
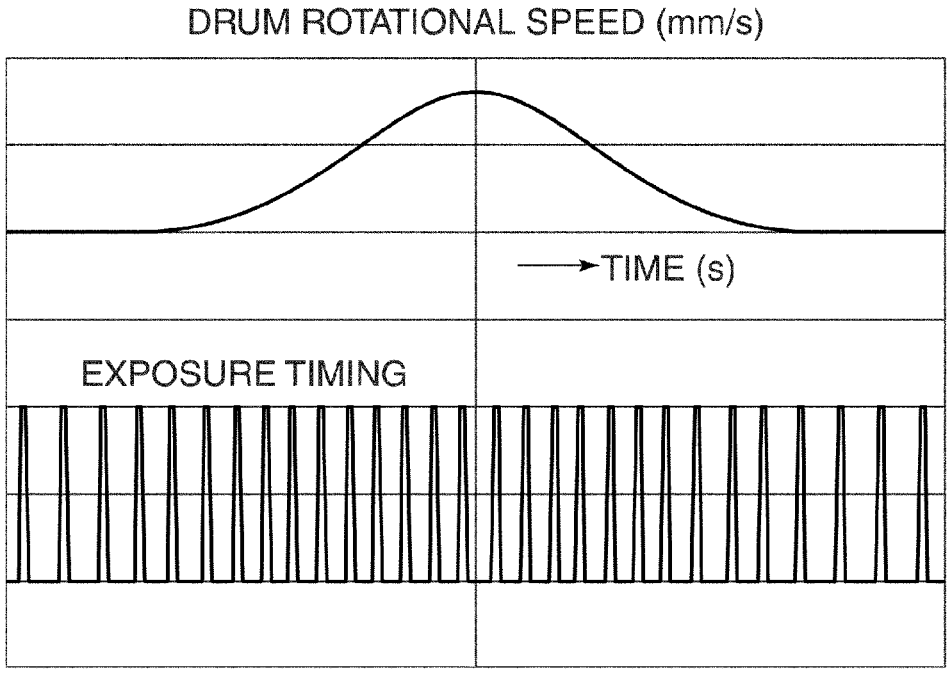
FIG. 9 is a diagram showing the relationship between drum rotational speed and exposure timing according to the embodiment of the present invention.

In the present embodiment, a control signal that narrows the interval between scanning lines by decreasing the interval between times at which light is output from the exposure unit 13 in an area where drum rotational speed is high, and widens the interval between scanning lines by increasing the interval between times at which light is output from the exposure unit 13 in an area where drum rotational speed is low is input to the exposure device 13. FIG. 9 is a diagram showing the relationship between drum rotational speed and exposure timing. By using exposure timing shown in FIG. 9, the intervals between scanning lines are made to be substantially uniform as shown in FIG. 8B to reduce or eliminate color misregistration.

Well-known techniques can be used to control the interval between times at which light is output from the exposure device 13. For example, as proposed in Japanese Laid-Open Patent Publication (Kokai) No. 2002-169120, a method that controls the rotational speed of a polygon mirror can be used. Also, as proposed in Japanese Laid-Open Patent Publication (Kokai) No. 2005-172997, a method that uses a BD (beam detect) signal obtained by detecting light for scanning output from an exposure device prior to scanning can be used. Detailed description of these control methods, however, is omitted here.

In the present embodiment, the above described control method that uses a BD signal is used, and more specifically, a method that changes the time intervals at which light is output based on a BD signal in accordance with a control signal is used. However, in the case where this method is used, if the amount of change in the time intervals at which light is output is too large, for example, if the interval between scanning lines is adjusted 10 μm or more, the problem that the writing position greatly varies from one scanning line to another will arise.

In the present embodiment, the amount of control over the exposure device 13 is limited so as to prevent the above described problem, and feedforward control of drum rotational speed is carried out so as to keep variations in drum rotational speed within a predetermined range. Namely, by keeping the fluctuation range of drum rotational speed within a predetermined range through feedforward control of drum rotational speed, the exposure device 13 can be controlled without bringing about the above described problem.

Specifically, through feedforward control of drum rotational speed, the amplitude of harmonic rotational speed fluctuations indicated by the arrows in FIG. 13 referred to earlier are controlled to be within a range of the half amplitude of low-frequency rotational speed fluctuations indicated by broken lines in FIG. 13. In this case, where the amplitude of harmonic rotational speed fluctuations is P [mm/s], and the half amplitude of low-frequency rotational speed fluctuations is Q [mm/s], a necessary attenuation rate is expressed by "1−Q/P". For example, because in the actual apparatus, P=15 [mm/s] and Q=6 [mm/s], a necessary attenuation rate is 0.6 (=60%).

In the present embodiment, however, with further consideration given to factors causing worsening situations such as an increase in variations due to endurance of a drive gear, feedforward control is carried out to control the amplitude of harmonic rotational speed fluctuations to 20% or less as compared to a case where the feedforward control is not carried out. It should be noted that a detailed description will be given later of how the amplitude of harmonic rotational speed fluctuations is controlled to be at least within the range of the half amplitude of low-frequency rotational speed fluctuations as a second embodiment.

In the present embodiment, it is assumed that an attenuation rate of the amplitude of harmonic rotational speed fluctuations is 0.8 (80%) as described above. Feedforward control of drum rotational speed is carried out based on a detection signal (HP signal) from the HP flag 8. Accordingly, the location at which the HP flag 8 is disposed is determined so that the amplitude of harmonic rotational speed fluctuations indicated by the arrows in FIG. 13 can be controlled to be 20% or less as compared to a case where the feedforward control is not carried out.

Figure 10:
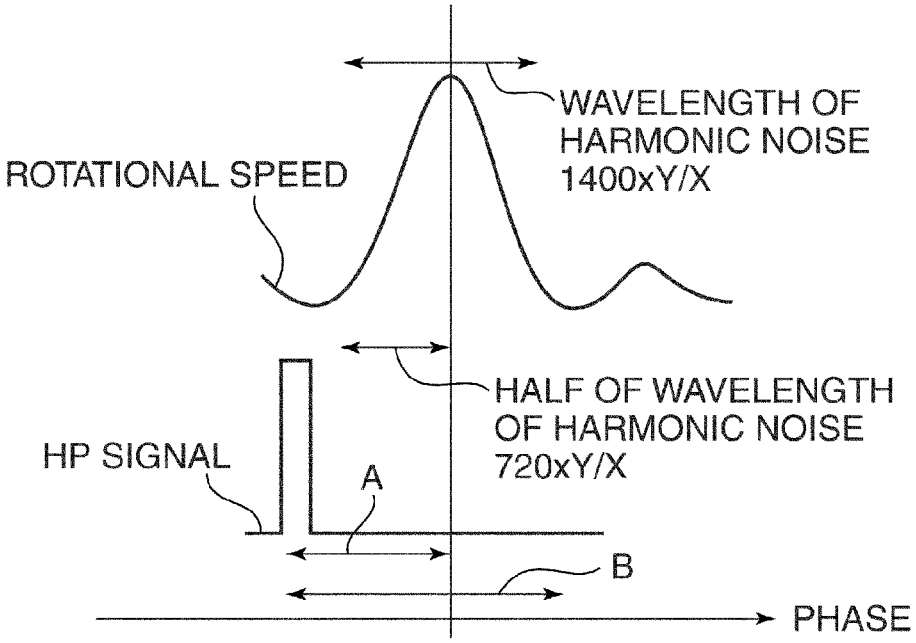
FIG. 10 is a schematic diagram showing the relationship between a harmonic rotational speed fluctuation and an HP signal.

FIG. 10 is a schematic diagram showing the relationship between harmonic rotational speed fluctuations and HP signal (the position of the HP flag 8). In FIG. 10, the horizontal axis represents phase, an upper side of the vertical axis represents drum rotational speed, and a lower side of the vertical axis represents a detection signal indicative of the HP flag 8 being detected.

Whenever the photosensitive drum 11 is driven, there is a resonant frequency (is produced). It has been empirically made clear that where this resonant frequency is X [Hz], a frequency band in which response to a disturbance input to the drum drive unit 1 is possible is about X/4 [Hz] or less. Thus, harmonic rotational speed fluctuations can be defined as those caused by frequencies outside the frequency band where response is possible, that is, frequencies not less than X/4 [Hz]. Moreover, where the rotational frequency of the photosensitive drum 11 is Y [Hz], the wavelength of harmonic rotational speed fluctuations can be defined as being not more than 360×Y/(X/4) [degrees], that is, not more than 1440×Y/X [degrees].

During feedforward control of drum rotational speed, the control controller 110 outputs a control signal when a time period derived from the drum rotational speed profile stored in the storage unit 111 has elapsed since the HP flag 8 was detected. Thus, the HP flag 8 has to be read by the HP sensor 9 a predetermined time period before the time at which harmonic rotational speed fluctuations starts.

It can be said that the time at which harmonic rotational speed fluctuations start is a half wavelength before harmonic rotational speed fluctuations reach a peak. Thus, the HP flag 8 has only to be detected a predetermined phase i.e. 720×Y/X [degrees] before the time (phase) at which harmonic rotational speed fluctuations reach a peak.

The time at which harmonic rotational speed fluctuations reach a peak is a phase that causes harmonic rotational speed fluctuations. Thus, the HP flag 8 has to be disposed 720×Y/X [degrees] or more before the phase that causes harmonic rotational speed fluctuations, that is, before the time at which harmonic rotational speed fluctuations reach a peak.

Namely, as shown in FIG. 10, the relationship "A>720×Y/X [degrees]" has to be satisfied where a phase from a pulse indicative of the HP flag 8 having being detected to a peak of harmonic rotational speed fluctuations is a phase A [degrees].

Figure 11:
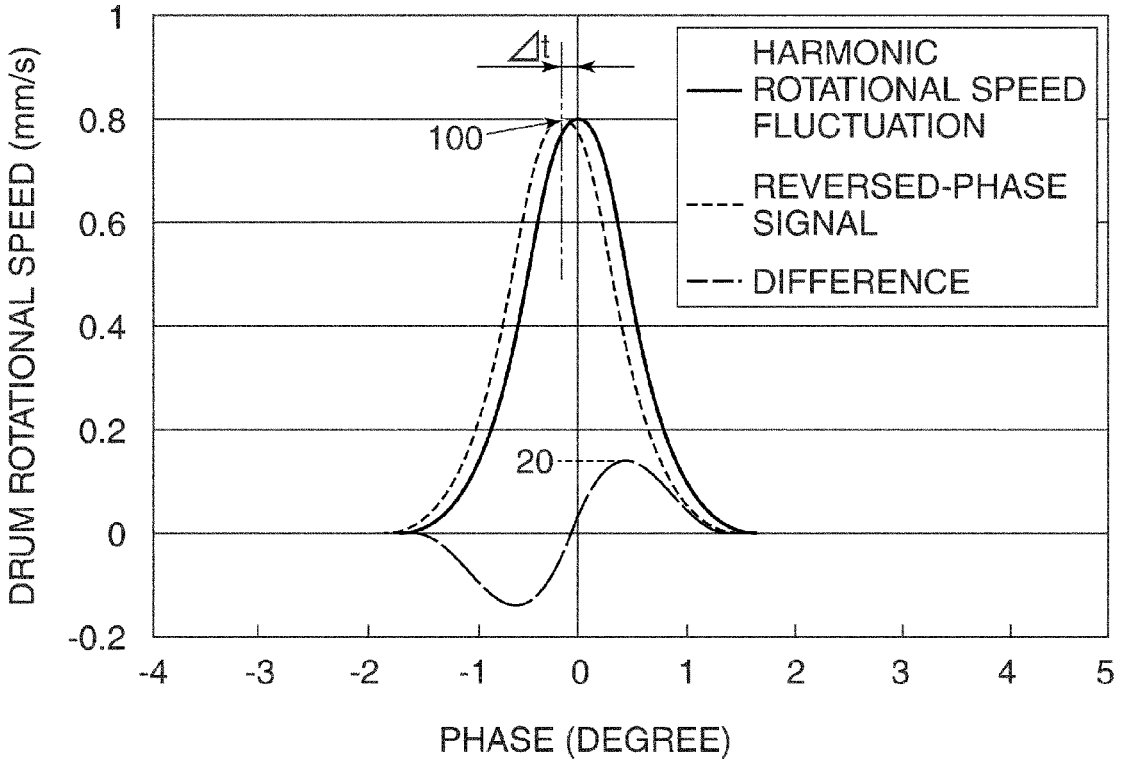
FIG. 11 is a diagram showing the relationship among a waveform indicative of a harmonic rotational speed fluctuation, a waveform of a reversed-phase signal for canceling out the harmonic rotational speed fluctuation, and a difference between these waveforms.

Next, a description will be given of the relationship between the location at which the HP flag 8 is disposed and the phase A, which is required to control the amplitude of fluctuations in drum rotational speed to 20% or less as compared to a case where feedforward control is not carried out. FIG. 11 is a diagram showing the relationship among a waveform indicative of a harmonic rotational speed fluctuation, a reversed-phase signal waveform for canceling out the harmonic rotational speed fluctuation, and a difference between these waveforms (control residue).

The greater Δt, the greater the amplitude of the difference waveform, where a difference between the center of the waveform of the harmonic rotational speed fluctuation and the center of the waveform of the reversed-phase signal. Thus, Δt is determined so that the amplitude of the difference waveform can be 20% or less of the amplitude of the harmonic rotational speed fluctuation. Δt is set to satisfy the following condition, "Δt<7.5% of the wavelength of the harmonic rotational speed fluctuation" through simulations.

Δt is expressed by the following equation, "Δt=A/V−A/(V+ΔV)" where the nominal value of drum rotational speed (set rotational speed) is V [mm/s], and the amplitude of fluctuations in drum rotational speed is ΔV [mm/s]. Because Δt is 7.5% or less of the wavelength of the harmonic rotational speed fluctuation, the following relationship holds, "A×(1/V−1/(V+ΔV))<0.075×1440×Y/X". Thus, the location of the HP flag 8 is set to satisfy the following relationship, "A<0.075×1440×(Y/X)/(1/V−1/(V+ΔV))". Here, the relationship "C=ΔV/V" where the ratio of the half amplitude of the drum rotational speed fluctuation to the set rotational speed is C. Thus, the relational expression between the phase A and phase C as described above can be modified like "A<0.075×1440×(Y/X)×(V(1+C)/C)".

It should be noted that ΔV is a part that has not been canceled out by control in a speed fluctuation that results from a cause (disturbance) that produces a low-frequency drum rotational speed fluctuation such as a gear all-teeth engagement error or a gear eccentricity component. Thus, ΔV can also be expressed by "ΔV=disturbance×disturbance elimination performance (sensitivity function)". The disturbance elimination performance can be determined by a designer based on mechanical arrangements in mechanical designing and main control gain settings in control system designing and can be actually measured. Also, a disturbance is mainly a gear all-teeth engagement error or a gear eccentricity component and is about 100 μm to 1 μm according to standards based on drawings for design of the actual apparatus, and further, it can be actually measured. Namely, ΔV is a value that has a high degree of design freedom and can be actually measured in the actual apparatus.

Figure 12:
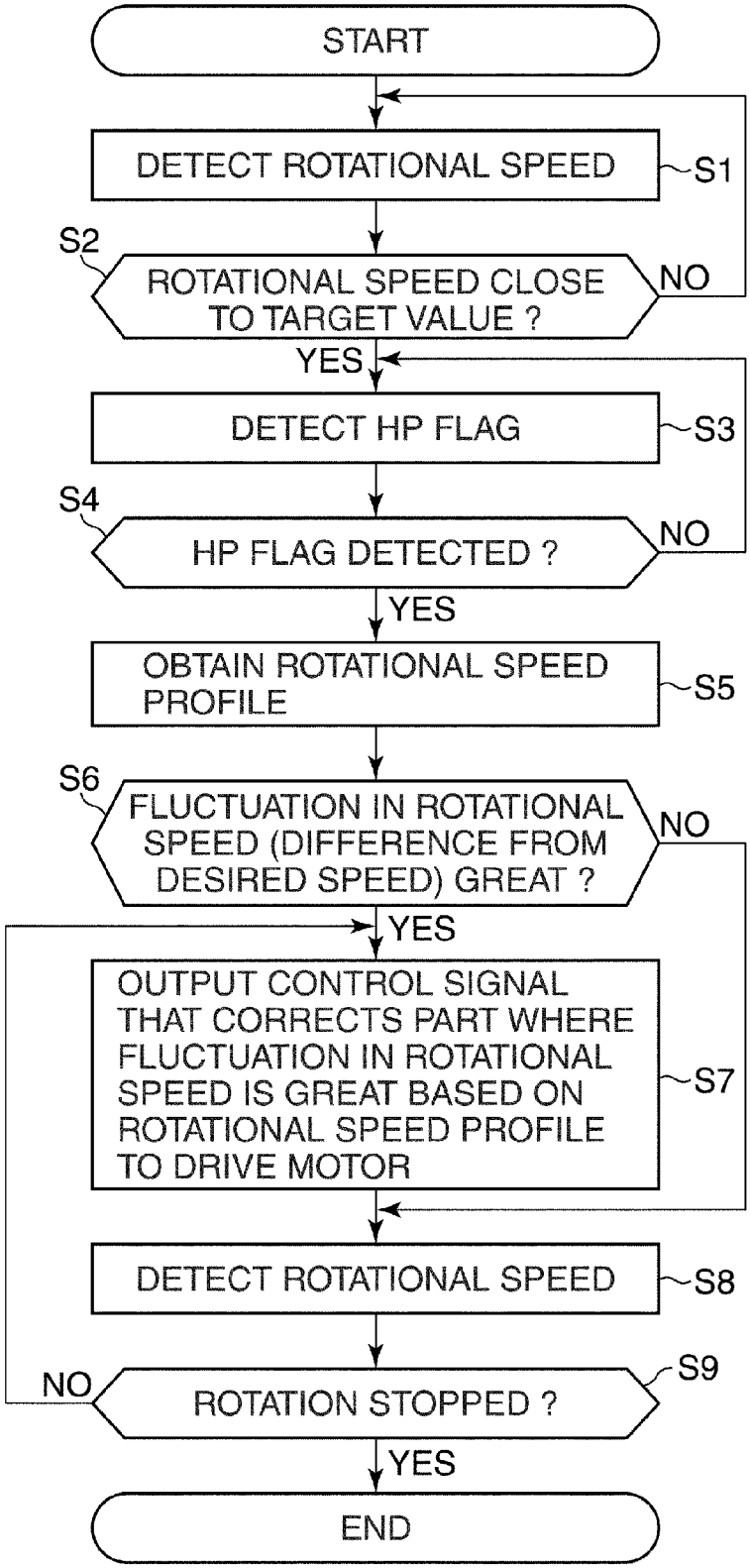
FIG. 12 is a flowchart of feedforward control by the drum drive unit shown in FIG. 2.

FIG. 12 is a flowchart of feedforward control by the drum drive unit 1. First, the control controller 110 causes the encoder sensors 4 to detect a drum rotational speed (step S1), and determines whether or not the detected drum rotational speed is close to a target value (set value) (step S2). Specifically, in the step S2, the control controller 110 determines whether or not the detected drum rotational speed lies within a range of ±10% of the target value for five seconds or more.

When the detected drum rotational speed is not close to the target value ("NO" in the step S2), the control controller 110 returns the process to the step S1. When the detected drum rotational speed is close to the target value (YES in the step S2), the control controller 110 carries out detection of the HP flag 8 (step S3) and determines whether or not the HP flag 8 has been detected by the home position sensor 9 (step S4). When the HP flag 8 has not been detected ("NO" in the step S3), the control controller 110 returns to the step S3. When the HP flag 8 has been detected ("YES" in the step S3), the control controller 110 obtains a drum rotational speed profile with a predetermined resolution by using the HP flag 8 as a starting point and stores the profile in the storage unit 111 (step S5).

The control controller 110 then determines whether or not a fluctuation in drum rotational speed is large, that is, there is a difference of a predetermined value or more between the obtained drum rotational speed and a desired drum rotational speed (step S6). Specifically, in the step S6, the control controller 110 determines whether or not the obtained drum rotational speed is 1% or more of the target drum rotational speed. When there is a large difference in drum rotational speed ("YES" in the step S6), the control controller 110 outputs, to the drive motor 6, a control signal for attenuating a part where drum rotational speed greatly changes (that is, harmonic rotational speed fluctuations) in the drum rotational speed profile (step S7). When there is no great difference in drum rotational speed ("NO" in the step S6), the control controller 110 proceeds the process to step S8.

In the step S8, the control controller 110 causes the encoder sensors 4 to detect a drum rotational speed, and determines whether or not the photosensitive drum 11 has stopped rotating (step S9). When the photosensitive drum 11 has not stopped rotating ("NO" in the step S9), the control controller 110 returns the process to the step S7. When the photosensitive drum 11 has stopped rotating ("YES" in the step S10), the control sequence is brought to an end.

As described above, in the present embodiment, in response to harmonic rotational speed fluctuations, feedforward control of drum rotational speed is carried out to control variations in drum rotational speed within a predetermined range, and a measure using the exposure device 13 is taken, so that high-quality images can be formed.

There is also an idea that if feedforward control is carried out to cope with fluctuations in the drum rotational speed of the photosensitive drum 11 caused by low-frequency noise, the problem itself to be solved by the present invention will disappear. However, in order to form a toner image on the photosensitive drum 11, it is necessary to carry out physical processes such as charging and transfer, and there may be cases where real-time feedback control is carried out for such physical processes.

Thus, these physical processes may cause disturbances to the operation of the photosensitive drum 11, and to eliminate disturbances caused by the physical processes, it is necessary to correct the rotational speed of the photosensitive drum 11 in real time. Thus, taking measures using real-time feedback control to the extent possible to cope with disturbances that can be eliminated by real-time feedback control contributes to stabilization of the quality of the actual apparatus being a product. Accordingly, in the present embodiment, real-time feedback control is adopted for fluctuations in the rotational speed of the photosensitive drum 11 caused by subharmonic noise.

In the first embodiment, the amplitude of harmonic rotational speed fluctuations is attenuated to 20% or less as compared to the case where feedforward control is not carried out, and in the second embodiment, a description will be given of the degree to which harmonic rotational speed fluctuations should be typically attenuated.

From simulation results in the first embodiment, the following expression can be derived, "$Q/P=2\times R+0.05$". Here, "R" is a ratio of $\Delta t$ to a wavelength $\lambda$ of harmonic rotational speed fluctuations having an arbitrary magnitude, and can be expressed by the following equation, "$R=\Delta t/\lambda$". Thus, from these equations, the following equation can be derived, "$\Delta t=(Q/(2\times P)-0.025)\times\lambda$". Thus, by controlling $\Delta t$ to not more than the right-hand side value in this equation, the amplitude of harmonic rotational speed fluctuations can be controlled to be within the half amplitude of low-frequency rotational speed fluctuations.

Namely, because "$\Delta t=\Delta T=A/V-A/(V+\Delta V)$" as described earlier in the first embodiment in "$\Delta t<(Q/(2\times P)-0.025)\times\lambda$", the following relational expression, "$A/V-A/(V+\Delta V)<(Q/(2\times P)-0.025)\times\lambda$" can be obtained. The location at which the HP flag 8 is disposed can be determined so that the following relational expression, "$A<V\times(1+1/C)\times(Q/(2\times P)-0.025)\times\lambda$", which is a modification of the above relational expression, can be established.

A third embodiment features a method to detect a detected drum rotational speed and a method to store information about a profile on the detected drum rotational speed in feedforward control of drum rotational speed in the first embodiment and the second embodiment.

In a case where information on a drum rotational speed profile for use in feedforward control of drum rotational speed is stored in the storage unit 111, control performance can be improved by increasing the resolution (sampling time) of the profile. This, however, will present the problem that a required capacity of the storage unit 111 will increase, resulting in cost increase. Accordingly, in the present embodiment, to improve (maximize) control performance with a limited storage capacity, important sections in the drum rotational speed profile are detected and stored with high resolution, and other sections are detected and stored with low resolution.

Important sections in the drum rotational speed profile mean the timing with which harmonic rotational speed fluctuations occur (phases), and the amplitude of harmonic rotational speed fluctuations. Thus, resolution has to be increased only in a range where harmonic rotational speed fluctuations occur. This range is indicated by a phase of $B$ ($=A+720\times Y/X$) [degrees] in FIG. 10 taking the position at which the HP flag 8 is disposed as a starting point. Resolution has to be increased only in this range B [degrees], and outside this range, resolution has to be decreased.

It should be noted that in a system that takes measures using feedforward control to cope with only harmonic rotational speed fluctuations as with the first embodiment, a drum rotational speed profile may be obtained within the range B [degrees], and a profile outside this range may not be stored in the storage unit 111.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-153873 filed Jul. 12, 2011, which is hereby incorporated by reference herein in its entirety.

What is claimed is:

1. An image forming apparatus comprising:

an image carrier whose surface is charged with electricity;

an exposure unit configured to form an electrostatic latent image by exposing the charged surface of said image carrier to light;

a drive unit configured to rotate said image carrier;

a first detecting unit configured to detect a rotational speed of said image carrier;

a second detecting unit configured to detect a home position of said image carrier;

an exposure control unit configured to control timing with which said exposure unit exposes said image carrier to light so as to suppress a harmonic rotational speed fluctuation of said image carrier;

a storage unit configured to store a profile corresponding to fluctuations in the rotational speed of said image carrier; and a drive control unit configured to carry out feedback control for said driving unit based on the rotational speed detected by said first detecting unit, and carry out feedforward control for said driving unit based on the home position detected by said second detecting unit and the profile, wherein said second detecting unit detects the home position in a phase that is a predetermined amount before a phase in which the harmonic rotational speed fluctuation of said image carrier occurs so that said exposure control unit can correct for the harmonic rotational speed fluctuation, and wherein a frequency of the harmonic rotational speed fluctuation is a frequency of X/4 [Hz] or more where a resonant frequency of said image carrier is X [Hz].

2. The image forming apparatus according to claim 1, wherein said drive control unit controls said drive unit so that the following relationship, $720\times Y/X<A<0.075\times 1440\times(Y/X)\times(V(1+C)/C)$, can hold where a rotational frequency of said image carrier is Y [Hz], a phase from the home position of said image carrier to a peak of the harmonic rotational speed fluctuation is A [degrees], a set rotational speed of said image carrier is V [mm/s], and a ratio of a half amplitude of a rotational speed fluctuation of said image carrier to the set rotational speed of said image carrier is C.

3. The image forming apparatus according to claim 2, wherein said drive unit comprises a motor that rotates said image carrier, and wherein upon said second detecting unit detecting the home position of said image carrier, said drive unit reads the profile stored in said storage unit, and carries out feedforward control that outputs, to the motor, a signal for correcting the rotational speed of said image carrier so that the relationship expressed by A, C, V, X, and Y can hold based on the read profile.

4. The image forming apparatus according to claim 1, wherein said drive unit comprises:

a motor that rotates said image carrier; and a gear mounted on a rotary shaft that rotates said image carrier, for transmitting a rotative drive force of the motor to the rotary shaft, wherein the harmonic rotational speed fluctuation occurs in a phase corresponding to a gate position of the gear.

5. The image forming apparatus according to claim 1, wherein said drive unit comprises:

a motor that rotates said image carrier; and a gear mounted on a rotary shaft that rotates said image carrier, for transmitting rotative drive force of the motor to the rotary shaft, wherein the harmonic rotational speed fluctuation occurs in a phase corresponding to a position of a rotation-inhibiting arrangement of the gear.

6. The image forming apparatus according to claim 1, wherein said drive unit comprises:

a motor that rotates said image carrier; and a gear mounted on a rotary shaft that rotates said image carrier, for transmitting rotative drive force of the motor to the rotary shaft, wherein the harmonic rotational speed fluctuation occurs in a phase corresponding to a rib position of the gear.

7. The image forming apparatus according to claim 1, wherein said drive unit comprises:

a motor that rotates said image carrier;

a joint provided at one end of a first rotary shaft mounted on said image carrier; and a coupling that is provided at one end of a second rotary shaft, to which rotative drive force of the motor that drives said image carrier is transmitted, in such a manner as to engage with the joint, wherein the harmonic rotational speed fluctuation occurs in a phase corresponding to a position of a projecting portion of the coupling which engages with the joint.

8. The image forming apparatus according to claim 1, wherein said drive unit comprises:

a motor that rotates said image carrier;

a joint provided at one end of a first rotary shaft mounted on said image carrier; and a coupling that is provided at one end of a second rotary shaft, to which rotative drive force of the motor that drives said image carrier is transmitted, in such a manner as to engage with the joint, wherein the harmonic rotational speed fluctuation occurs in a phase corresponding to a position of a rotation-inhibiting arrangement of the coupling for the second rotary shaft.

9. The image forming apparatus according to claim 1, wherein said first detecting unit comprises an encoder wheel that is mounted on a rotary shaft rotating said image carrier, wherein the harmonic rotational speed fluctuation occurs in a phase corresponding to a position of a rotation-inhibiting arrangement of the encoder wheel for the rotary shaft.

10. The image forming apparatus according to claim 1, wherein the drive unit comprises:

a fixed part fixed to a rotary shaft that rotates said image carrier; and an inertial member mounted on the rotary shaft via the fixed part, wherein the harmonic rotational speed fluctuation occurs in a phase corresponding to a position of a rotation-inhibiting arrangement of the fixed part for the rotary shaft.

11. The image forming apparatus according to claim 2, wherein after said second detecting unit detects the home position of said image carrier and before $A+720\times Y/X$ [degrees] determined by A, X, and Y has passed, said first detecting unit makes a resolution with which the rotational speed of said image carrier is detected higher than in other ranges.

12. The image forming apparatus according to claim 2, wherein only after said second detecting unit detects the home position of said image carrier and before $A+720\times Y/X$ [degrees] determined by A, X, and Y has passed, said first detecting unit detects the rotational speed of said image carrier.

* * * * *